US006192973B1

(12) United States Patent
Schwerdtfeger et al.

(10) Patent No.: US 6,192,973 B1
(45) Date of Patent: Feb. 27, 2001

(54) STRIP CASTING PLANT

(75) Inventors: Klaus Schwerdtfeger, Goslar; Karl-Heinz Spitzer, Clausthal-Zellerfeld; Ulrich Urlau, Moers; Dietmar Franke, Netzen, all of (DE); Bernfried Stache, Sewickley, PA (US); Joachim Kroos, Melne; Heino Buddenberg, Wolfen, both of (DE)

(73) Assignee: Mannesmann AG, Düsseldorf (DE)

( * ) Notice: Subject to any disclaimer, the term of this patent is extended or adjusted under 35 U.S.C. 154(b) by 0 days.

(21) Appl. No.: 09/194,848

(22) PCT Filed: Jun. 3, 1997

(86) PCT No.: PCT/DE97/01149

§ 371 Date: Mar. 4, 1999

§ 102(e) Date: Mar. 4, 1999

(87) PCT Pub. No.: WO97/47410

PCT Pub. Date: Dec. 18, 1997

(30) Foreign Application Priority Data

Jun. 7, 1996 (DE) ..... 196 22 928
Sep. 10, 1996 (DE) ..... 196 36 699

(51) Int. Cl.[7] ..... B22D 11/06; B22D 11/12
(52) U.S. Cl. ..... 164/441; 164/447
(58) Field of Search ..... 164/441, 447, 164/484

(56) References Cited

U.S. PATENT DOCUMENTS 3,283,368 * 11/1966 Homan ..... 164/416
3,446,270 * 5/1969 Michelson ..... 164/441
3,627,591 * 12/1971 Pfeuffer et al. ..... 164/447 X
3,797,557 * 3/1974 Tseitlin et al. ..... 164/447
5,350,009 * 9/1994 Mizoguchi et al. ..... 164/441 X

FOREIGN PATENT DOCUMENTS

588616 * 11/1933 (DE) .
3423834 * 10/1987 (DE) .
0526886 * 2/1993 (EP) .
60-36855 * 8/1985 (JP) ..... 164/441
5-200493 * 8/1993 (JP) ..... 164/484
1002087 * 3/1983 (SU) ..... 164/441

OTHER PUBLICATIONS

Patent Abstracts of Japan, vol. 017, No. 635 (M–1514), Nov. 25, 1993 and Japanese Patent Publication 5–200492 Published Aug. 10, 1993.*

Patent Abstracts of Japan, vol. 014, No. 367 (M–1008), Aug. 9, 1990 and Japanese Patent Publication 2–133150 Published May 22, 1990.*

* cited by examiner

*Primary Examiner*—J. Reed Batten, Jr.
(74) *Attorney, Agent, or Firm*—Cohen, Pontani, Lieberman & Pavane

(57) ABSTRACT

The cast steel strip must be supported, particularly after the casting device, to reduce stresses and mechanical deformations. A flexible support element, in particular, a chain with rolls, whose length can be changed by suitable adjustment devices, is arranged for the purpose of support after the casting device.

8 Claims, 1 Drawing Sheet

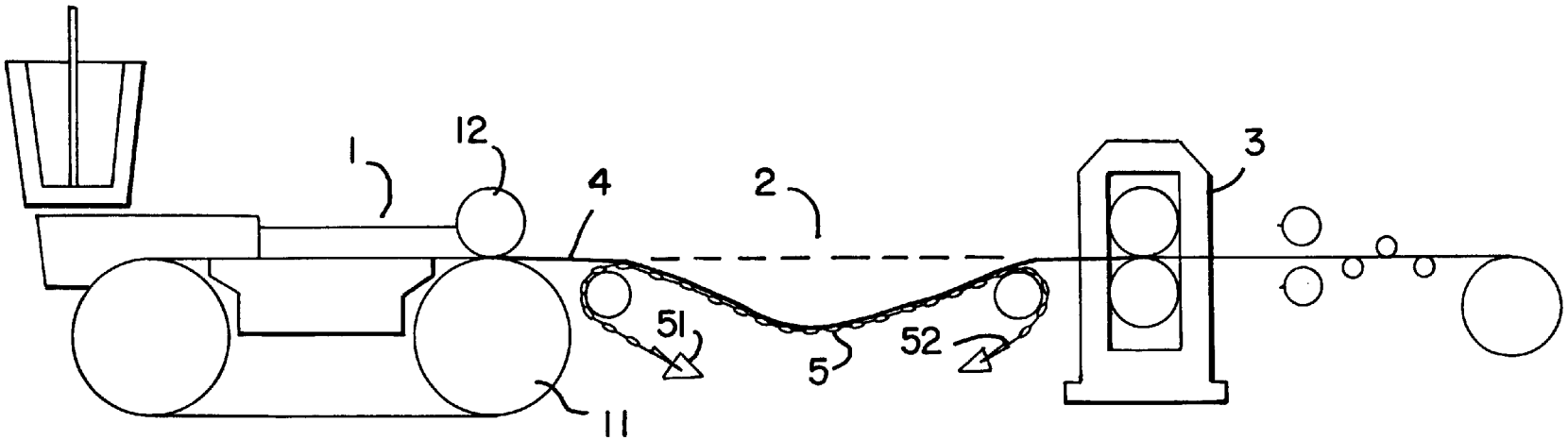
3
52
5
2
51
4
11
12
1

STRIP CASTING PLANT

BACKGROUND OF THE INVENTION

1. Field of the Invention

The invention relates to a strip casting plant, particularly for the casting of metal strips, especially steel strips.

The steel strips produced with the casting plant preferably have thicknesses of up to 10 mm.

2. Discussion of the Prior Art

A casting plant for the casting of steel melts, in particular, is described in DE 34 23 834 C2. The molten steel passes from a supply container through a nozzle onto a continuously revolving, cooled and roller-supported belt. The solidified strip is conveyed by conveyance devices to a downstream unit for further processing, particularly rolling. The solidified strip is still relatively soft and, in any case, should not be bent immediately after casting, i.e., after leaving the revolving belt of the casting machine. In addition, considerable temperature differences between the strip interior and the strip surface still exist.

SUMMARY OF THE INVENTION

The object of the invention is to reduce thermal and mechanical stresses in the cast strip. According to the invention, a flexible support element is therefore located in an arrangement connected to the casting plant. Specifically, the flexible support element is held between the casting plant and a downstream conveyance device. The flexible support element serves to absorb the vertical forces caused by gravity. To this end, the length of the support and guidance element is adjustable. The flexible element can consist, for example, of clamped steel strips, which can be mounted on rollers, in particular, whereby the rollers can be driven rotating with or synchronously to the conveyance devices. Advantageously, in the case of a support element that rotates with the conveyance devices, the strip tension forces can be minimized. The drive is controlled for this purpose.

In a preferred embodiment, the flexible support element consists of a link chain in the manner of a bicycle chain, whereby multiple chains are arranged next to one another in the direction of the strip width or are interwoven with one another in such a way as to provide an adequately large supporting surface.

In a further preferred embodiment, the flexible support element, i.e., specifically, the chain, has rolling elements. These rolling elements can be embodied as rolls rotating in the strip conveyance direction or as spherical elements. In these embodiments, it is again crucial to absorb the vertical forces and ensure that the transport of the cast strip in the conveyance direction is as free of friction as possible. The rolling elements are preferably driven in a simultaneously rotating fashion and/or in sections in the strip longitudinal direction, so as to avoid tension and pressure stresses in the supported area.

In a further preferred embodiment, adjustment devices are arranged on the flexible support element, i.e., the supporting belt or the preferred chain with rolling elements for the purpose of adjusting the tension of the flexible support element in its longitudinal direction. This permits adjustment of the suspension curve and thus of the length of the line segment supported by the flexible support element. As a result, along with supporting the belt and reducing stresses in the cast strip, it is advantageously possible to balance different rotation speeds of the conveyance devices (conveyance rolls). The flexible support element thus also functions as a buffer/for the adjustment of strip tension. If a particular conveyance device has a higher speed than the previous conveyance device, it is possible, by shortening the flexible support element and simultaneously reducing the speed of the downstream conveyance rolls, to balance the strip tension. Conversely, if the speed of the downstream conveyance rolls is too low, the stress on the flexible support element can be reduced, so as to enlarge the support length and at the same time increase the speed of the downstream conveyance rolls.

Preferably, in conjunction with suitable measurement and processing devices, the supported length of the flexible support element can be changed by adjustment devices, which are adjustable in a controlled fashion, in accordance with the torque of the simultaneously rotating roll in the casting plant.

In the case of an endless, revolving belt or chain, tensions rollers can be used, for example, as adjustment elements.

In the case of a finite belt or chain, hydraulic clamping cylinders are preferably arranged at the belt ends or at one belt end. In particular, a combination of a revolving belt with a supporting chain can be provided.

BRIEF DESCRIPTION OF THE DRAWINGS

The invention is described in greater detail in reference to the example shown schematically in the accompanying drawing.

DETAILED DESCRIPTION OF THE PREFERRED EMBODIMENTS

The casting plant according to the invention consists of a casting device 1 with an endlessly revolving belt, a compensation line 2 and a downstream conveyance device 3. The cast strip 4 is conveyed between the conveyance device 3 and the roll 11 of the casting device 1. The flexible support element 5 is arranged in the compensation line 2 between the conveyance device 3 and the roll 11. As indicated, the flexible support element 5 is embodied as a chain with rolls. The chain 5 is held via support rolls 51 and chain adjusters 52. The suspension curve of the chain 5 determines the length of the strip 4. In a tensed position, the strip 4 is conducted practically aligned in the dashed-line position between the conveyance roll 11 and the conveyance device 3. At reduced chain tension, the strip sags between the rolls 51 in keeping with the suspension curve.

In conjunction with the measurement and control devices (not shown), the tension of the chain 5 is controlled in accordance with the torque on the roll 12. Preferably, the speed of the rolls of the conveyance device 3 is also controlled by the control device.

The arrangement of a flexible support element 5 is advantageous whenever a cast strip 4 must be supported to reduce vertical loads. The flexible support element 5 can therefore advantageously be used not only in strip casting plants, but also in casting plants for other demensions.

In a further preferred arrangement, the length of the support element 5 is modified in such a way that a constant supporting force is exerted on the supported strip 4. To this end, the force acting on the chain is determined in dependence on position, for example. The supporting force to be established as the control variable results from the difference relative to the force measurement with strand, taking into account the inertial forces.

In a further preferred arrangement, the chain or the belt is rotary-mounted at one or more point, so that two or more loops are created. In this way, sagging is reduced and a necking of the support element, for example, for establishing a protective gas atmosphere, can have a lower volume.

What is claimed is:

1. A horizontal strip casting plant, comprising:

a melt supply;

cooling means for cooling the melt into a solidified strip; and a flexible guidance and support element, arranged after the cooling means, for guiding and supporting the solidified strip, the guidance and support element being configured to have an adjustable length.

2. A casting plant as defined in claim 1, wherein the flexible support element is a chain.

3. A casting plant as defined in claim 1, wherein the flexible support element includes rolling elements.

4. A casting plant as defined in claim 1, wherein the support element is a belt.

5. A casting plant as defined in claim 1, wherein the support element forms an endless loop.

6. A casting plant as defined in claim 5, wherein the support element is configured to revolve.

7. A casting plant as defined in claim 1, and further comprising adjusting means arranged on the flexible support element for regulating stress in a longitudinal direction of the support element.

8. A casting plant as defined in claim 7, wherein the adjusting means includes at least one tension roller.

* * * * *